US005134808A

United States Patent [19]

Panetti

[11] Patent Number: 5,134,808

[45] Date of Patent: Aug. 4, 1992

[54] METHOD OF PROGRAMMING AND PERFORMING THE REPROFILING OF RAILS OF A RAILROAD TRACK AND RAILROAD VEHICLE FOR CARRYING OUT THE SAME

[75] Inventor: Romolo Panetti, Geneva, Switzerland

[73] Assignee: Speno International S.A., Geneva, Switzerland

[21] Appl. No.: 560,574

[22] Filed: Jul. 31, 1990

[30] Foreign Application Priority Data

Aug. 28, 1989 [CH] Switzerland ..... 3107/89

[51] Int. Cl.[5] ..... B24B 49/00

[52] U.S. Cl. ..... 51/165.71; 51/165.74; 51/281 R; 51/326; 51/178; 364/474.06

[58] Field of Search ..... 51/165.71, 165.74, 165.75, 51/165.76, 281 R, 326, 178; 364/474.06, 474.09, 474.15

[56] References Cited

U.S. PATENT DOCUMENTS 3,888,052 6/1975 Panetti ..... 51/281 R
4,091,578 5/1978 Panetti .
4,115,857 9/1978 Panetti .
4,347,688 9/1982 Scheuchzer et al. ..... 51/165.87
4,417,466 11/1983 Panetti .
4,531,837 7/1985 Panetti .
4,541,182 9/1985 Panetti .
4,785,589 11/1988 Buhler ..... 51/178
4,905,422 3/1990 Panetti .
4,920,701 5/1990 Panetti .

FOREIGN PATENT DOCUMENTS 633336 11/1982 Switzerland .
654047 1/1986 Switzerland .
655528 4/1986 Switzerland .
666068 6/1988 Switzerland .

*Primary Examiner*—M. Rachuba
*Attorney, Agent, or Firm*—Young & Thompson

[57] ABSTRACT

The invention relates to a programming method for the reprofiling of rails according to which the track is divided in successive sections as from a starting point and for each of these sections one proceeds for each line of rails to the measuring of the wavelength and/or of the amplitudes of the longitudinal undulations of the rolling table of the rail and to the measure of the transverse profile of the head of the rail. One compares thereafter a reference profile to the measured transverse profile and determines the transverse metal section to be removed to correct the transverse profile of the rail, then one determines as a function of the amplitudes of the longitudinal undulations of the rail the longitudinal metal section to be removed to correct the longitudinal profile of the rail. One determines the total section of metal to be removed and as a function of the speed of working, of the characteristic of metal removal of each tool, and of this total metal section to be removed the necessary number of minimal tool-passes. The invention also relates to a machine for reprofiling the rails according to the method.

15 Claims, 9 Drawing Sheets

FIG. 2
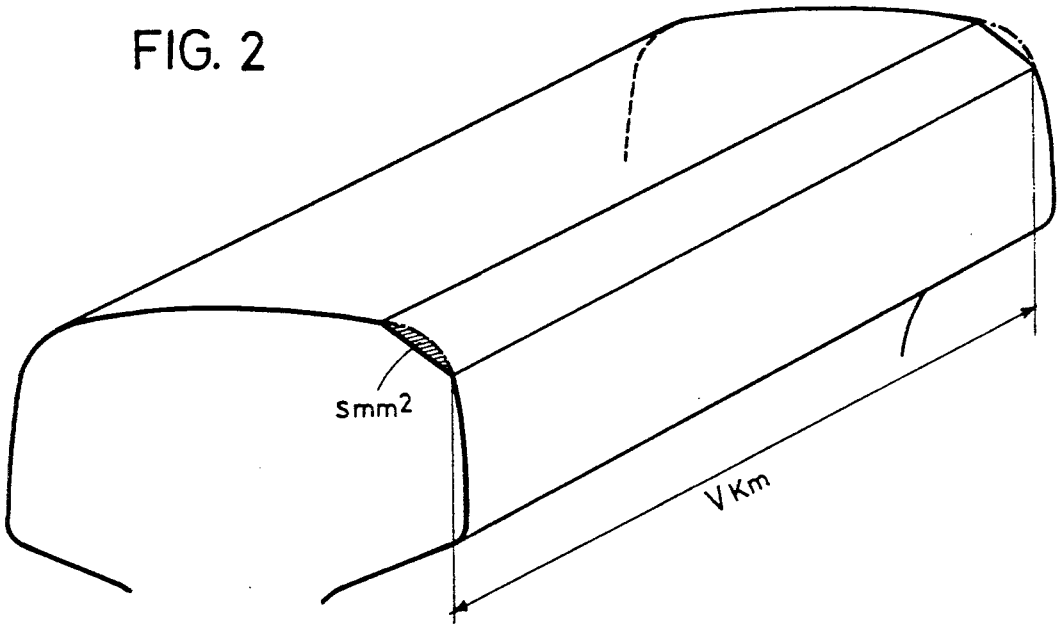
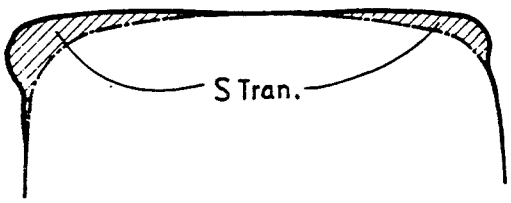
FIG. 3a

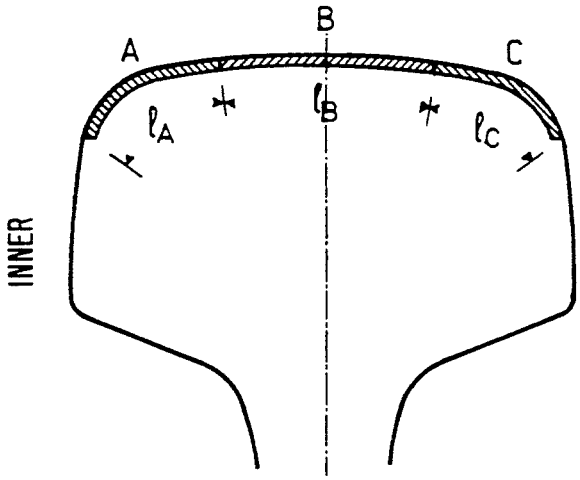
$S_{TOT} = S_A + S_B + S_C$
FIG. 11
FIG. 12
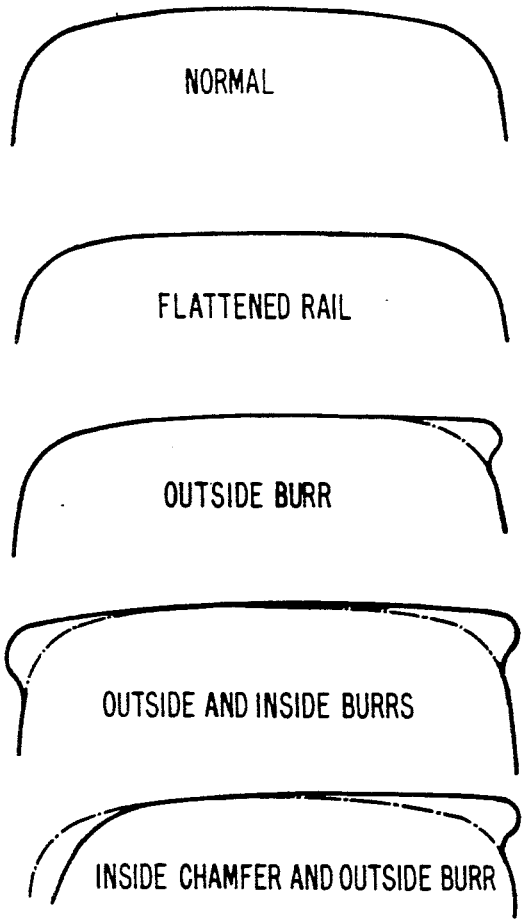
| $S_A$ | $S_B$ | $S_C$ |
|---|---|---|
| $= S_B = S_C$ | | |
| SMALL | $S_B = 0$ | SMALL |
| SMALL | SMALL | LARGE |
| LARGE | SMALL | LARGE |
| ZERO | SMALL | LARGE |

METHOD OF PROGRAMMING AND PERFORMING THE REPROFILING OF RAILS OF A RAILROAD TRACK AND RAILROAD VEHICLE FOR CARRYING OUT THE SAME

FIELD OF THE INVENTION

The invention relates to a programming method for the reprofiling of rails according to which the track is divided in successive sections as from a starting point and for each of these sections one proceeds for each line of rails to the measuring of the wavelength and/or of the amplitudes of the longitudinal undulations of the rolling table of the rail and to the measure of the transverse profile of the head of the rail. One compares thereafter a reference profile to the measured transverse profile and determines the transverse metal section to be removed to correct the transverse profile of the rail, then one determines as a function of the amplitudes of the longitudinal undulations of the rail the longitudinal metal section to be removed to correct the longitudinal profile of the rail. One determines the total section of metal to be removed and as a function of the speed of working, of the characteristic of metal removal of each tool, and of this total metal section to be removed the necessary number of minimal tool-passes.

The invention has further for its object a machine for reprofiling the rails according to the method.

The present invention has for its object a programming method for the reprofiling, a method for the reprofiling it-self of the rails of a railroad track as well as a railroad vehicle to carry it out.

BACKGROUND OF THE INVENTION

The increase of the traffic and of the speeds (TGV, Intercity), the introduction of cadenced timetables have notably increased the stresses to which the rails are submitted and consequently, the deformations of the longitudinal and transverse profiles of the head of the rail.

The timetables which are more and more charged leave for the maintenance of the rails and of the tracks only more and more reduced time intervals. It is thus necessary to proceed to an optimal programming of these works, in order to use fully the intervals at disposition.

Now the determination of the number of passes is empirical, it depends mainly on the experience acquired by comparing the preceeding grinding works. For example, one knows that for a given track, of a given network, presenting a given undulatory wearing off, the number of passes to be made with the usually used machine is of the order of "X". If the transverse profile is no longer perfect, one adds a number "Y" of passes, so that the total will be "X+Y".

Such an empirical practice is no longer possible due to the requirements relative to the quality now required from the reprofiled rails and of the occupation time of the tracks which is always greater.

One knows numerous reprofiling or profiling methods for the rails of a railroad track, as well as of railroad vehicles equiped with devices to make this work as described for example in Swiss patents CH 633.336; CH 654.047; CH 666.068; CH 655.528 and in Swiss patent application CH 817/88. All these methods and these devices do not permit however to program in an optimal way the reprofiling operations of the rails of a railroad track as a function of the type of the machine to be used, and of the occupation rates of the track, of the wearing off state of the rails and of the metal removal capacity of the reprofiling tools.

SUMMARY OF THE INVENTION

It is precisely the aim of the present invention to permit such a programming in advance of the reprofiling operations which enables to define the setting parameters for the machines which will have to make the work later on or simultaneously.

The aim of the present invention is thus to:

Define for a given section of track the optimum number of passes and the speed of work so as to limit to a minimum the occupation time of the track.

Permit an independent programming work from the rectification work, which is the normal case, or during the rectification work by adapting, in this later case, the speed of the machine and the different parameters influencing the removal of metal to the measured excess of metal in front of the machine.

Enable the independent programming by means of a vehicle equiped with devices for measuring the longitudinal and transverse profiles of the rail, as well as of supports permitting to store these measured values as a function of the elapsed way on the track.

Enable that the calculation of the working speed and of the number of passes can be made either on the independent measuring vehicle or on a separate device, but the results have to always be given as a function of the curvilinear abscissa of the track, so that they can be used for an immediate reprofiling that is a quasi simultaneous, as well as for a reprofiling made later on.

The present invention has for its object a method to optimalize the programming of the reprofiling machines of the rails of a track characterized by the fact that for at least one line of rails one:

1. Divides the track into sections of length L0.
2. Determines the average amplitude of the longitudinal undulation "h avg" along the section L0
3. Determines the average profile "P avg" of the head along the section L0.
4. Compares this average profile with a reference profile "Préf" to determine (S tran=Préf−pavg) the section Stran of metal to be removed due to the deformation of the transverse profile of the rail.
5. Determines the section Slong of metal due to the longitudinal wearing off of the rails along this section L0 (Slong=f3 havg).
6. Determines the total cross section Stot of metal to be removed (total cross section Stot=Slong+-Stran).
7. Determines the number of tool-passes PO as a function of the capacity of metal removal of the tools and of the working speed (PO=Stot. V/C; or C=F(Pu) where Pu=power.
8. Optimalizes this number of passes (PO) by acting on ("V and Pu") the speed of work and the power.
9. Records these values (PO; V; Pu).

BRIEF DESCRIPTION OF THE DRAWINGS

The attached drawings shows schematically and by way of example, different embodiments of the method according to the invention as well as a machine to carry it out.

FIG. 2 shows the calculation of the volume of metal having to be removed by reprofiling a small face of the rail.

FIGS. 3*a*, 3*b* and 3*c* show respectively the transverse cross sections, longitudinal and total of metal to be removed for the reprofiling of the rail.

FIG. 11 shows a variant of the method according to which one decomposes the head of the rail in three areas.

FIG. 12 shows a repartition of the surfaces SA, SB and SC of each of these zones, representing the section of metal to be removed for different types of profiles of worn rails.

DETAILED DESCRIPTION OF THE INVENTION

Figure 4:
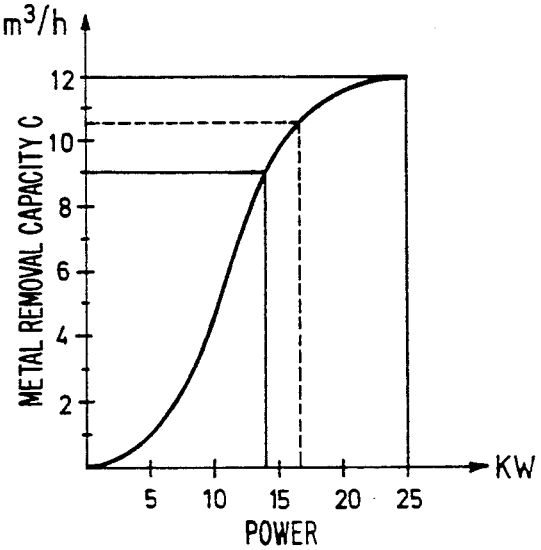
FIG. 4 shows the capacity of metal removal during one hour of a tool, i.e. a grinding wheel, as a function of the power of its driving motor.

Series of measurements made, on track as well as on a test bank have permitted, for a given tool working at a constant power Pu on a rail of defined quality, to determine the metal removal capacity C of said tool. The repetition of these tests at different powers permits to establish characteristic curves Pu=f(C) and to store them. They permit thus to deduce the power Pu kW which is necessary to apply to the tool to obtain a desired metal removal "C" $dm^3/h$ as shown at FIG. 4.

When the tool, driven in rotation at a constant speed Pu kW, displaces at a constant speed Vkm/h along the rail, it will remove from the rail a certain quantity of metal making onto the rail a small face having a constant section "s" $mm^2$.

After 1 hour of work, the tool will have made a distance of Vkm, corresponding to the length of the small face, and will have removed from the rail a quantity of metal which is equivalent to "C" $dm^3$ where from the relation $$C = V \cdot s[dm^3]$$

which is taken from FIG. 2,

Taking account of different units, it becomes:

$$C[dm^3/h] = V[km/h] \cdot s[mm^2]$$

The section of the small face being defined as a function of the metal removal capacity of the tool and of its speed of displacement along the rail, it is necessary, to determine the number of necessary passes for the reprofiling of a section of rail to define the quantity of metal having to be removed from the rail to give it again its correct desired profile. It is thus necessary to determine the total section Stot of metal to be removed to find again the reference profile.

This section Stot is divided in two partial sections:

$S_{tran}$ which corresponds to the section of metal which is necessary to remove to correct the transverse profile of the rail as seen in FIG. 3*a*.

Figure 3B:
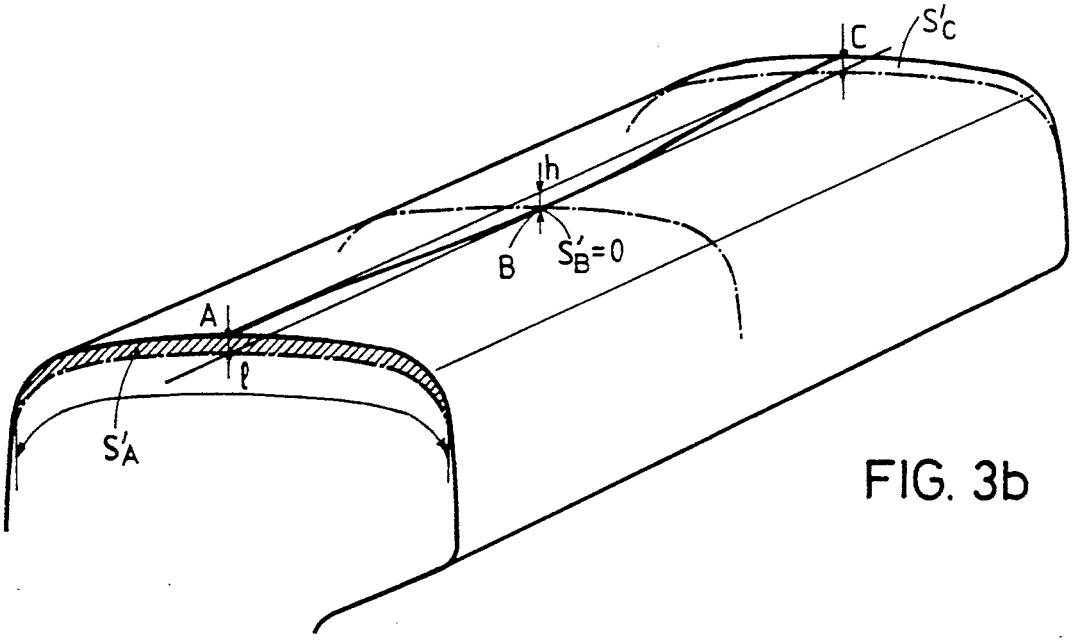

$S_{long}$ which corresponds to the section of metal which is necessary to remove to correct the longitudinal profile of the rail as shown in FIG. 3*b*. This section is not constant along the rail, it varies from $S'_A = S'_C = S'max$ at the summits of the undulation to $S'_B = 0$ at the bottom of the wave.

Experience has shown that the actual section of metal to be removed SLong depends on the development "l" of the profile to rectify and on the average amplitude of the wave to be corrected.

$$S_{Long} = f_1 \cdot l \times f_2 \cdot \text{havg}$$

where $f_1$ and $f_2$ are experimental factors.

For a determined rail profile, this relation can be further simplified under the form:

$$S_{Long} = f_3 \cdot \text{havg}$$

the factor $f_3$ takes into account the shape of the profile, as well the one of the wave.

Figure 3C:
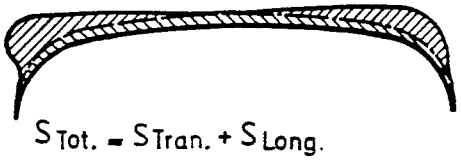

The total section $S_{tot}$ of metal to be removed is thus the sum of the transverse section and of the longitudinal section $$S_{Tot} = S_{Tran} + S_{Long} \text{(FIG. 3c)}$$

With the total section $S_{tot}$ of metal to be removed being defined, and the section of metal to be removed by one tool being known, one deduces the number PO of tool-passes necessary for the reprofiling of the rail:

$$PO = \frac{STot}{s} = Stot \frac{V}{C} \text{ then } C = V \cdot S$$

For a machine having N tools for each line of rails, the number of machine-passes PM will be:

$$PM = STot \cdot \frac{V}{C} \cdot \frac{1}{N}$$

With the number of machine-passes, the forward working speed and the length of the track being known, the working program of the machine and the occupation of the track are defined.

By varying the speed V and the capacity C of metal removal in limits defined by the practice, by acting on the driving power of the tool, it is possible to define an optimal entire number of machine-passes, which is indispensable since the available intervals are more and more reduced for the reprofiling work of the rails of a track.

The programming method of the reprofiling operations of the rails of a railroad track will be described with reference to block diagram of FIG. 1 to facilitate its comprehension.

One measures the elapsed path or the position of the vehicle along the track, or also its kilometrical point, by means of a coder 1 carried by a measuring wheel in contact with the rail 2 of the track and delivering electrical signals which are representative of the position.

Figure 9:
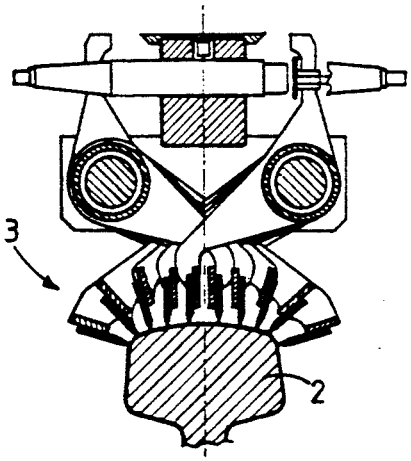
FIG. 9 shows a detail of the measuring device for the transverse profile of the rail.

One measures the transverse profile of the rail 2 by means of a feeler 3 which can be for example an optical feeler, an ultrasonic or a mechanical feeler such as the one shown at FIG. 9 and described in European patent EP 0.114.284. This feeler delivers electrical signals which represents the transverse profile of the head of the rail.

One measures further the wavelength and/or the depth of the longitudinal undulations of the rolling surface of the rail 2 by means of a captor 4 being part of an apparatus such as described in European patent EP 0 044 885 for example. This captor 4 delivers electrical signals which represent the amplitude of these longitudinal undulations.

These captors 3 and 4, as well as the coder 1 can be mounted on a common carriage 5 rolling on the rail 2.

For taking the transverse profile of the rail, as well as for measuring the amplitude of the longitudinal undulations of the rail, it is preferable to proceed by sampling. One determines in 6 the distance X between two desired samples and stores the signals representative of said profile samples P and amplitude undulations h in 7 and 8 respectively.

The sampling is made at regular intervals which are predetermined, for example all half meters, and the track is divided in sections of length L0 for each of which the reprofiling characteristics will be programmed and thereafter the reprofiling executed. This reference length L0 is recorded in 9.

At the end of each section of track $\Sigma$ x=L0, one causes in 10 the start of the calculation in 12 of the average profile P on the distance L0, that is $\overline{P}$ and in 11 the calculation of the average amplitude h on the section L0 that is $\overline{h}$.

The average profile P is given by the average of all measured profiles P on the reference length L0

$$\overline{P} = \frac{x}{L0} \cdot \Sigma \text{ Profiles}$$

One can disregard the two profiles which are the most apart from the average in order not to introduce any error in the average.

The average profile $\overline{P}$ for each section of track L0 is memorized in 12 in the form of a matrix for example and compared in 13 to the reference profile which is previously determined and which is memorized in 13*a* also under the form of a matrix. This determined reference profile is chosen among the possible reference profiles stored in 13*b*. This reference profile Préf. may be identical for all the sections of track L0 or on the contrary can be different for each of them or at least for certain of these sections L0.

The comparison between the reference profile and the average profile $\overline{P}$ average of each section L0, as well as the calculation of the section $S_{tran}$ of metal to be removed can be made in rectangular coordinates, or in polar coordinates or under a matrix form according to the known methods. The values of Stran=Pmoy−Préf are stored in 14.

The average amplitude $\overline{h}$ of the longitudinal undulations of the rail on the section L0 can be the arithmetical average of the absolute values of h measured on the section, or the quadratic average, depending upon the measuring apparatuses and selected and upon the habits of the user.

If it is desired to have a more precise method of programming one can differentiate between the short waves (for example 3 cm to 30 cm) from the long undulations (for example 30 cm to 3 m) and calculate the respective average for each of the wavelength OC and OL which the rolling table of the rail presents on the section L0.

This average amplitude $\overline{h}$ on the section L0, calculated according to the desired manner is memorized in 11 and used for the calculation of the section of metal SLong.

The calculation of the longitudinal section of metal to be removed $$S_{Long} = f_3 \cdot \overline{h}$$

is made in 15.

The total section of metal to be removed is given by the sum $$S_{tot} = S_{tran} + S_{long}$$

and this addition is made in 16 and displayed and memorized in the general display/memory 17.

Knowing the type of machine which will be used for the rectification of the track and whose characteristics are stored in 18, one can select in 19 the maximum Vmax and minimum Vmin speed of work which can be used for the reprofiling. One memorizes in 20 the characteristics of the tools of the machine to be used for the reprofiling, that is the necessary power as a function of the capacity of metal removal as shown at FIG. 4 for example.

In 21, one stores the number of tools for each line or rails which the machine used comprises for the reprofiling, this number of tools N is displaced and stored in 17.

The purpose is, having the knowledge of the total section of metal to be removed and the characteristics of the machine to be used, to optimalize the speed of work and the power of the tools to determine the minimum required number of machine-passes.

In a first step, one calculates this number of machine-passes by using the maximum speed Vmax and a capacity of metal removal for each tool $C_1$ which is somewhat lower than the maximum capacity of removal Cmax and one has $$\text{Machine-passes} = \frac{S_{tot}}{C_1} \cdot \frac{V\text{max}}{N} = PM\text{max}$$

When the number of maximum machine-passes PM max is not an entire number, it comprises:

a whole number of passes IP and of a fractional number of passes FP

In this case, one proceeds in a second step to a second calculation to determine another working speed of the machine in order to obtain a whole number of passes equal to the entire portion of the maximum machine-passes previously calculated for the maximum speed.

$$V = V\text{max} \frac{IP\,(PM\text{max})}{PM\text{max}}$$

then one checks that the obtained speed V is higher or equal to the minimal working speed Vmin for the given machine.

If V≧Vmin then one uses the speed V for the reprofiling.

If however V<Vmin, it will be necessary to increase the metal removal capactiy of the tools as a function of the characteristics of the tools of the machine to be used (see FIG. 4). The new metal removal capacity will be:

$$C_2 = C_1 \cdot \frac{V\min}{V} \text{ with } C_2 \leqq C\max \text{ and } C_2 > C_1$$

and this determines the necessary power for the value $C_2$ of metal removal according to the curve of FIG. 4.

One has thus determinated:

| | |
|---|---|
| the number of machine-passes | PM |
| the working speed | V Km/h |
| the metal removal | C $dm^3/h$ |
| the power of each tool | Pu . . . KW |

$$C2 = 9 \cdot \frac{5}{4.286} = 10.5 \text{ dm}^3/\text{h}$$

According to FIG. 4

$$Pu = f(C)_2 \text{ for } C = 10{:}5 \rightarrow Pu = 16{:}5 kw;$$

One then has:

Total Section: Stot=33:6 $mm^2$

Number of machine-passes: Pm=2

Working speed: V=5 km/h (=Vmin)

Power of each tool: Pu=16:5 kW

Corresponding metal removal: C=10, 5 $dm^3/h$

It is possible from this data memorized in the display 17 to make a record for a given track of the necessary characteristics for the programming of the reprofiling which can be done in the following manner:

| Line: Geneva - LAUSANNE | | | Track: 1 | | | | | | | Date: | |
|---|---|---|---|---|---|---|---|---|---|---|---|
| MACHINE: 16-P – N = 8 Tools/file - Tool No 601 - ac 90 A UIC | | | | | | | | | | | |
| | | | Left Rail | | | | Right Rail | | | | |
| Kilometric point P.K. | Speed km/h V | Machine-passes P.M | $mm^2$ Stot | $mm/_{100}$ $h_{rvg}$ | kW Power | $dm^3/h$ C | $mm^2$ Stot | $mm/_{100}$ $h_{ang}$ | kW Power | $dm^3h$ C | Lo |
| 30.100 | 5 | 2 | 33.6 | 40 | 16.5 | 10.5 | 28 | 30 | 13 | 8.75 | 50 |
| 30.150 | 5 | 2 | 36 | 45 | 18 | 11.25 | 24 | 25 | 12.5 | 7.5 | 50 |
| 30.200 | | | | | | | | | | | |
| 1 | 2 | 3 | 4 | 5 | 6 | 7 | 8 | 9 | 10 | 11 | 12 |

These sequential and recurrent calculations are made in 22 and the speed V, the number of machine-passes PM and the power of each tool Pu are displayed and memorized in 17.

It is evident that the most deformed line of rails will determine the number of passes to be made and it will be possible for the other line of rails to diminish the power of the tools.

The numerical example given hereafter shows clearly how one operates according to the present method of programming to determine the optimal number of machinepasses.

Numerical Example

Datas:

Vmin=5 km/h

Vmax=6 km/h

N=8 motors/line of rails

Stot=33; 6 $mm^2$

Curve Pu=f(C); see FIG. 4

$C_1$=9 $dm^3/h$ for Pu=14 kW

The first calculation for Vmax=6 km/h $$\text{Machine-passes} = \frac{S}{C_1} \cdot \frac{V\max}{N} = \frac{33.6}{9} \cdot \frac{6}{8} = 2.8\ PM$$

The number of passes is not a whole number, in order to make the work in two passes, the speed has to be reduced.

$$V = V\max \cdot \frac{2}{2.8} = 6 \cdot \frac{2}{2.8} = 4.286 < V\min$$

Since the speed is lower than the mimimal working speed desired, it is necessary to increase the metal removal capacity.

One can note the following:

Only the columns 1, 2, 3, 6, 10 and eventually 12 are necessary for the programming of the reprofiling, but the other columns are useful.

The program is made for a machine having 16 tools that is 2×8 for each line of rails.

The program could have been made for any number of tools; at the limit for only one tool for each line of rails.

h avg is not specified. One could calculate two values the one for the OC and the other for the OL and print them; one could thus have two values $\bar{h}_{OC}$ and $\bar{h}_{OL}$ inserted in this table.

Figure 5:
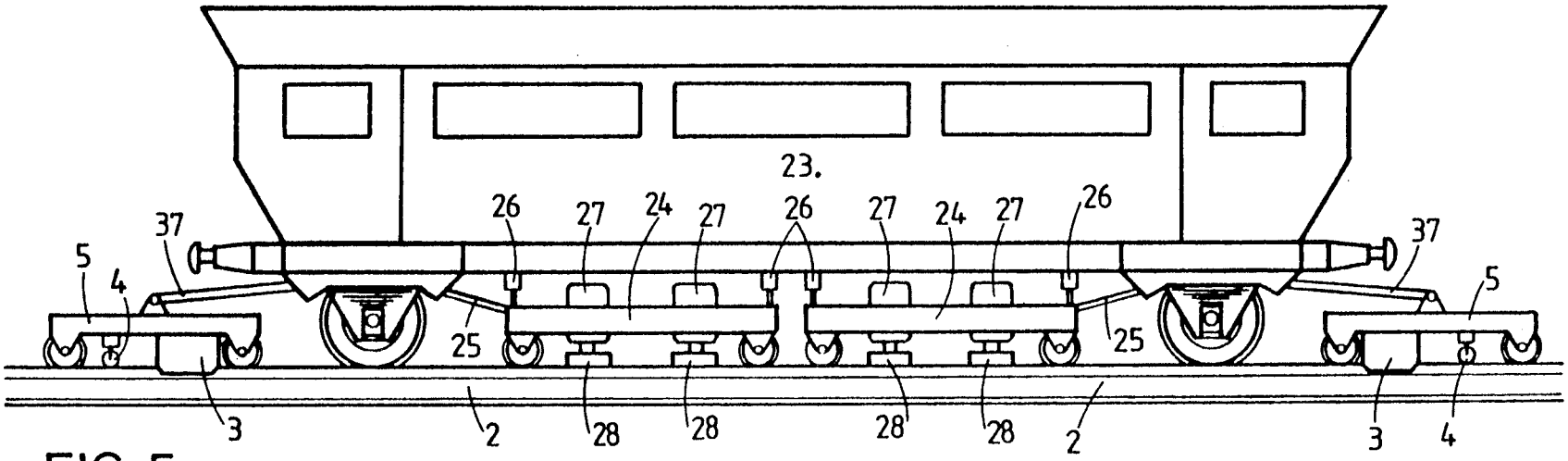
FIG. 5 shows in side elevation a reprofiling vehicle.
Figure 6:
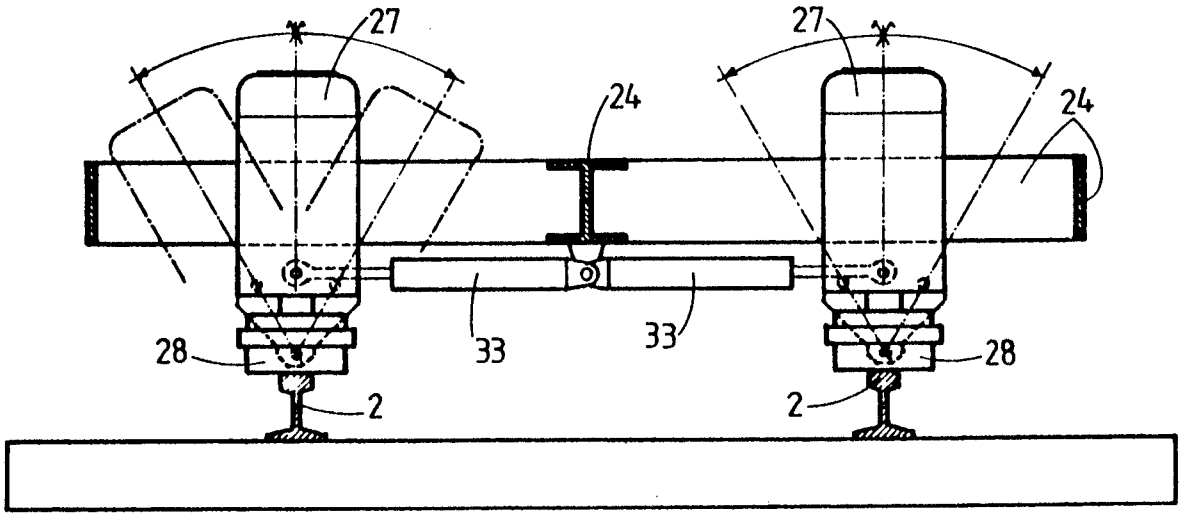
FIGS. 6 to 8 show details of the vehicle shown at FIG. 5.

FIG. 5 shows, from the side, a machine for the rectification of the rails of a railroad track constituted by an automotor vehicle 23 provided with grinding carriages 24. These grinding carriages 24 are provided with flange rollers resting, in working position, on the rails of the track and are connected to the vehicle 23 on the one hand by a traction rod 25 and on the other hand by lifting jacks 26. These lifting jacks 26 enable on top of the application of the carriage onto the track with a desired force, the lifting of said carriage for a high speed running of the vehicle 23 for its displacement from one grinding workplace to the other.

Each grinding carriage 24 carries several grinding units for each line of rails, each of these grinding units comprises a motor 27 which drives a grinding wheel 28 in rotation.

These units can work in an independent way or on the contrary be associated one to the other according to the grinding mode chosen as a function of the length and of the amplitude of the longitudinal undulations.

Figure 7:
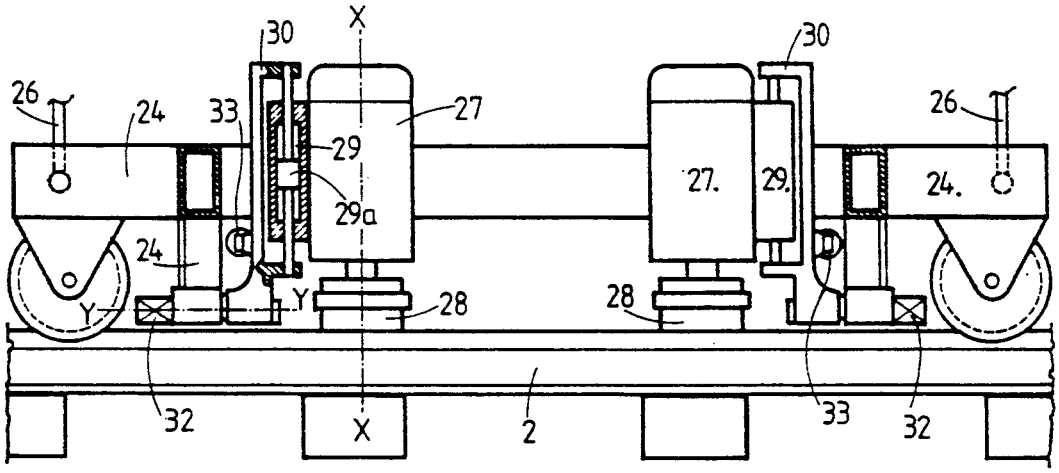
Figure 8:
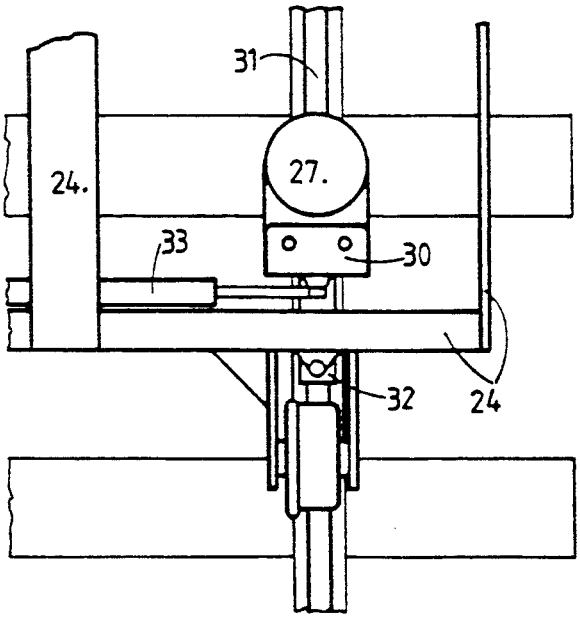

As particularly well seen on FIG. 7, each grinding unit 27, 28 is displaceable along its longitudinal axis X—X with respect to the carriage 24. In fact, the motor 27 carries the chamber 29 of a double effect jack whose piston 29*a* is fastened with a rod, crossing the chamber 29, fast with a support 30. This support 30 is articulated on the carriage 24 around an axis Y—Y, parallel to the longitudinal axis of the rail 2. The angular position of the grinding units is determined and controlled by the angle detector 32 fast with the support 30 and a double effect jack 33 connecting this support 30 to the carriage 24.

In this way, each grinding unit is angularly displaceable around an axis parallel to the longitudinal axis of the rail, to which it is associated and perpendicularly to this longitudinal axis enabling to displace it toward the rail and to apply the grinding stone 28 against the rail 2 with a determined force, as well as to displace it away from the rail.

The vehicle 23 is further equipped with two measuring carriages 5 rolling along each line of rail provided with measuring device 4 for the longitudinal undulations of the surface of the rail 2 and with a measuring device 3 of the transverse profile of the head of the rail. The carriages 5 are of course driven by the vehicle 23 for example by means of a rod 37. The measuring device of the transversal profile of the rails is shown schematically at FIG. 9 under the shape of an assembly of mechanical feelers in contact with different sidelines of the head of the rail (see Swiss patent CH 651 871).

The machine described comprises further (FIG. 10) a data handling device for the data delivered by the captors 1 of the elapsed distance, 4 of the longitudinal undulations of the rail, and 3 of the transverse profile of the rail and of control of the reprofiling units 27, 28 in position, as well as in power to reprofile the rail 2 so as to give it a longitudinal and a transverse profile identical or near the reference profile which is assigned to it.

Figure 10:
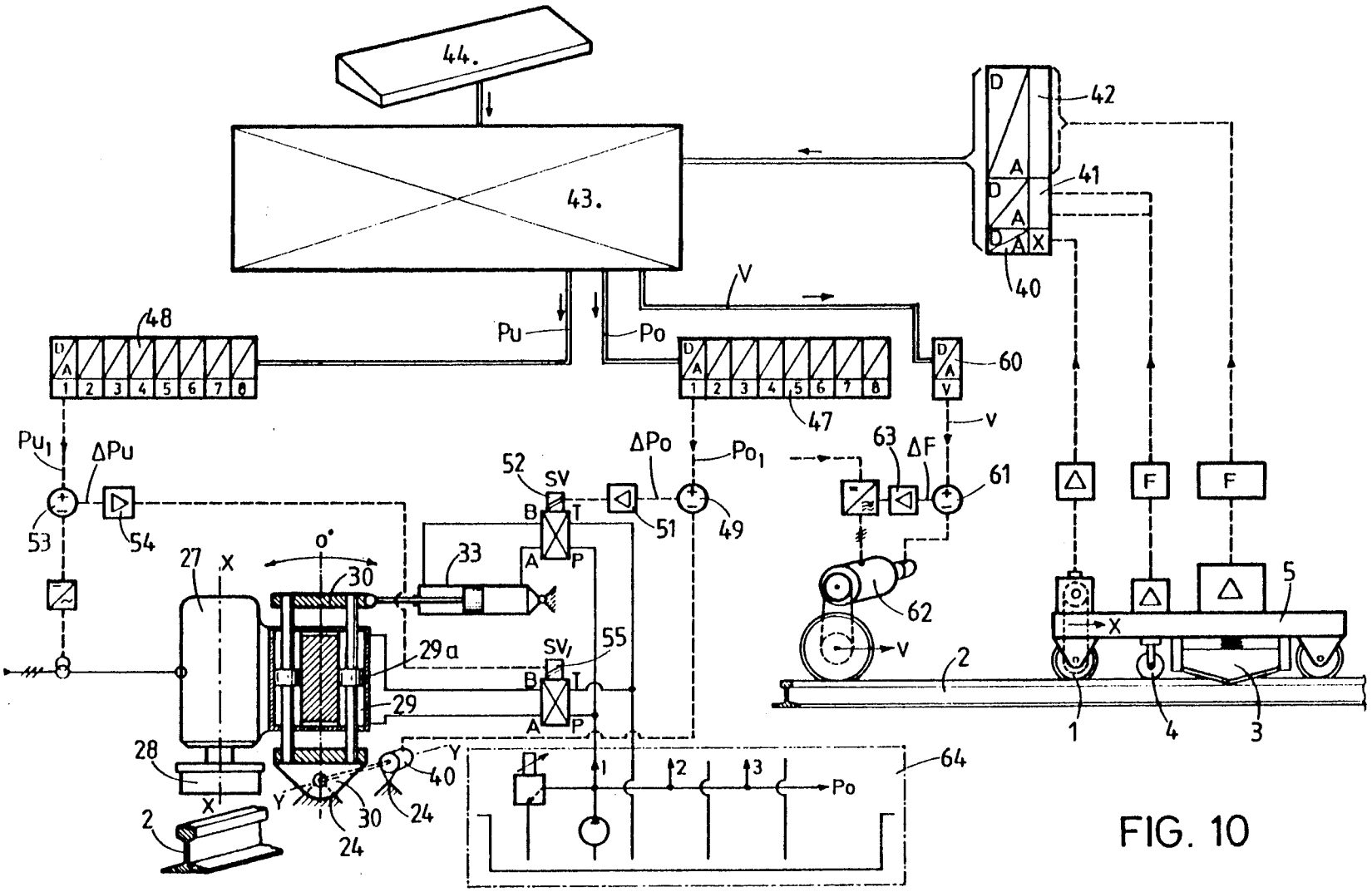
FIG. 10 is a schematic representation of a control device of the grinding units of the reprofiling vehicle.

This handling device of the measuring and controlling signals of the reprofiling units is schematically shown at FIG. 10. It comprises for each line of rails three analogue-digital converters 40, 41, 42 respectively associated with the captors 1, 4 and 3, transforming the analogical measuring signals delivered by these captors into digitals signals which are delivered to a microprocessor 43.

This micro-processor 43 receives further information which are either manually introduced by means of an alphanumerical keyboard 44 relating for example to the type of machine used, the number of grinding units for each line of rails which it comprises, and to the metal removal capacity of the tools used as a function of the power of the motors driving these tools.

One introduces also by this alpha-numeric keyboard the data defining the reference profiles, as well as the length of the reference sections L0, the distance x between the sampling and the starting kilometric point P.K.

The micro-processor 43 determines as a function of the data which has been furnished to it and which has been enumerated herein-above for each reprofiling unit working on the two lines of rails a digital control signal of the position P0 and a power control signal Pu as well as a control signal V of the working speed of the vehicle.

Digital to analogue converters 47, 48 convert these digital control signals P0, Pu into analogue control signals for each reprofiling units 27, 28. A digital to analogue converter 60 converts the digital control signal of the speed V into an analogue control signal.

FIG. 10 shows the feedback loop of a reprofiling unit, the unit No 1 of rail 2 of the track.

The analogue position signal $P0_1$ is compared in a comparator 49 to the output signal of an angle captor 40 indicating the angular position of the support 30, and thus of the grinding unit around the axis Y—Y parallel to the longitudinal axis of the rail. If there is no equality between the signal p0, and the one delivered by the angle captor 40, the comparator delivers a correction signal of the position Δ P0, which is positive or negative, controlling by means of an amplifier 51 a servovalve 52 controlling the double effect jack 33 fed with fluid under pressure by the hydraulique group 64, thus enssuring the angular positionning of the grinding unit 27,28.

The analogue signal $Pu_1$ is compared by means of comparator 53 to a signal which is proportional to the instantaneous power of the motor 27 and, in case of inequality of these signals, the comparator 53 delivers a correction signal of the power Δ Pu controlling, through the intermediary of an amplifier 54 a servovalve 55 controlling the double effect jack 29, and piston 29*a* which modifies the pressure of the grinding tool 28 against the rail 2.

The analogic speed signal V delivered by the digital to analogue convertor 60 fed by the micro-processor 43 is compared by means of a comparator 61 to a signal proportional to the speed of the motor 62 driving the vehicle 23 and in case of inequality of these signals, the comparator 61 delivers a correction signal Δ F controlling through the intermediary of an amplifier 63 the electric feeling frequency of the driving motor 62.

Thus, the described machine for carrying out the method of programming and reprofiling comprises for each line of rails, measuring means of the transverse profile, of the elapsed distance, of the longitudinal profile of the rail and of the amplitude of the undulations of great or small wavelength.

Once the reprofiling work has been programmed as described herein-above one can determine, in a known manner, the position of the grinding tools, as a function of the measured transverse profile of the rail to enable, by means of the programming data, to control a reprofiling machine such as the one which has just been described.

For example, one embodiment of the programming method, completed by the control of a reprofiling machine, will be described hereinafter. In this particular case, one had choosen to divide the head of the rail in three zones A, B, C, shown at FIG. 11, having a length LA, LB, LC.

The total metal surface to be removed is shown by the dashed zones.

$$Stot = SA + SB + SC$$

FIG. 12 shows for different types of wearing off of a rail, the value of the metal sections SA, SB, SC to be removed.

Figure 13:
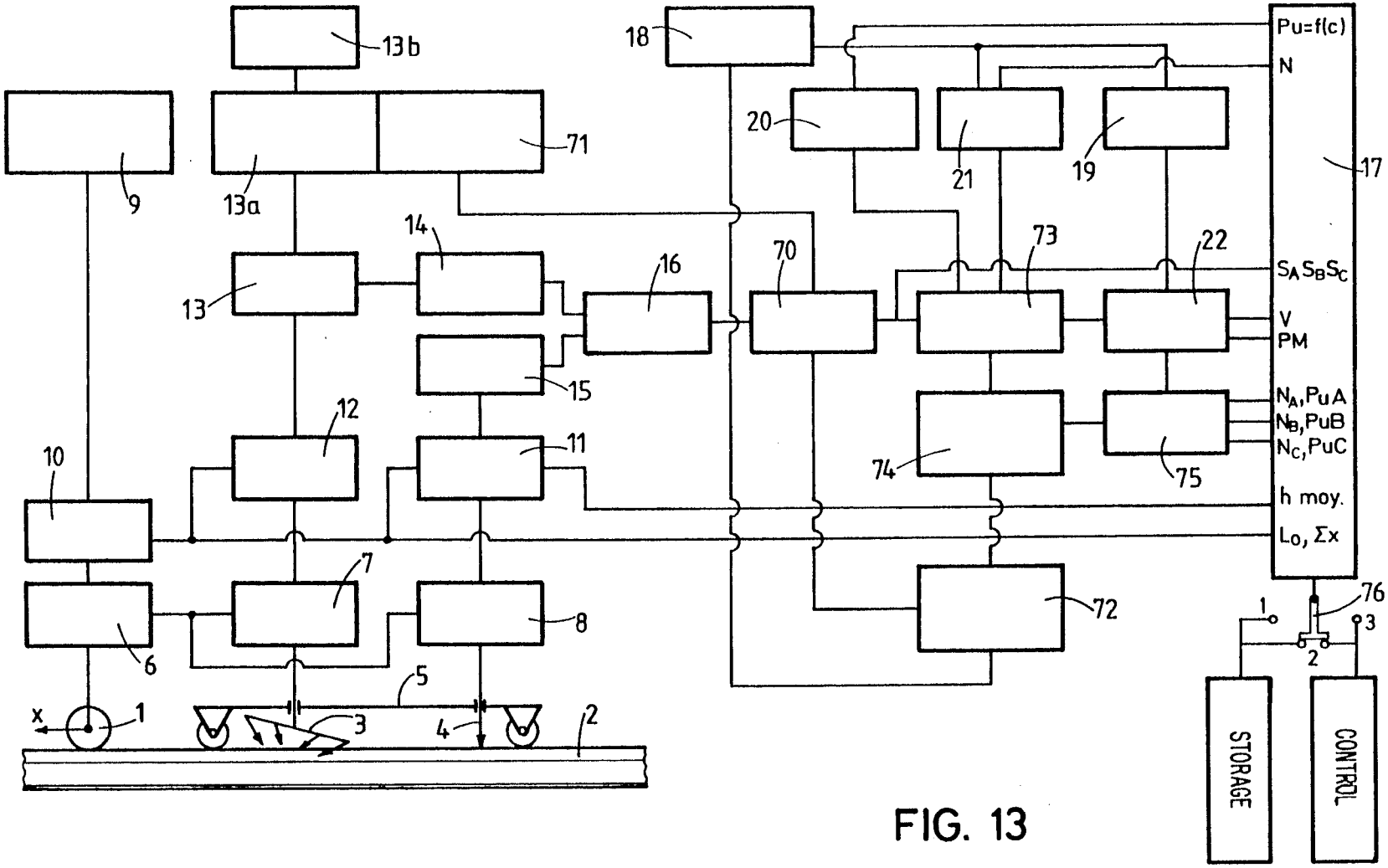
FIG. 13 shows a block diagram of the operations to be made in the variant of the method using the decomposition in three zones of the head of the rail.

FIG. 13 is a block diagram showing the programming and control operations of a reprofiling machine according to the principle of dividing the head of the rail into three zones A, B, and C.

Figure 1:
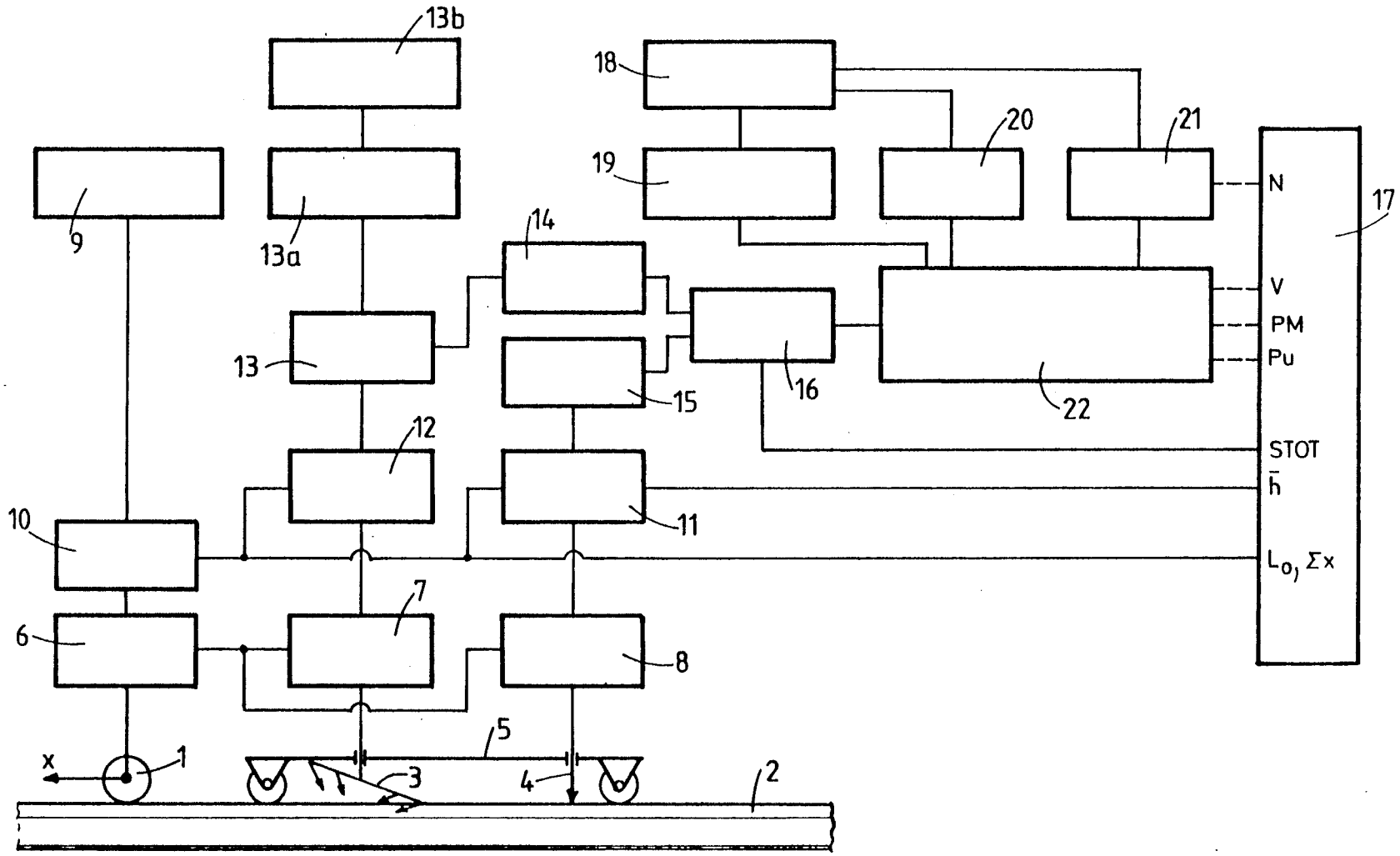
FIG. 1 shows a block diagram of the necessary functions for the programming of the reprofiling of a rail.

The elements and operations already described in reference to FIG. 1 carry the same reference ciphers and will not be redescribed here to shorten the disclosure.

In 70, the total surface of the head of the rail 2 is divided in three zones A, B, C of equal or unequal length according to the decisions of the programmer. This is done by means of the knowledge in 16 of the total section of metal to be removed and of a subdivision of the reference profile in three parts memorized in 71 for example under the form of a matrix. The sections SA, SB and SC are displayed and stored in 17.

In 72, the standard angular configurations which the grinding units may take for the type of machine indicated in 18 are memorized.

With the aid of the characteristics of the tools, that is of the necessary power as a function of the metal removal capacity memorized in 20, and of the number of tools memorized in 21 and of the chosen repartition in 70 for the three zones A, B, C of the head of the rail, one determines in 73 the number of tools affected to each of these zones. This enables to optimalize in 22 the speed V and the number of passes by knowing also the speeds Vmin and Vmax stored in 19. One displaces and stores in 17 the working speed V which has been calculated and the number of machine passes PM having been determined.

In 74, one selects among the geometric configurations of tools memorized in 72, the one corresponding to the number of tools for each zone determinated in 73 and in 75, one determines the configuration in power of the tools affected to each of these zones A, B, C as a function of the geometrical configurations chosen in 74 and of the optimalization made in 22. One displaces and stores for each zone A, B, C, the power Pu and the number of tools N in 17.

One has thus not only proceeded to the programming of a grinding operation but also determined the necessary parameters for the control of a reprofiling machine of the rails.

By means of the selector 76 having three positions, it is possible when it is in position 1 to record the data memorized in 17 and to establish records of the characteristics for the programming and the control of the reprofiling; when it is in position 2 to make this record and simultaneously to control a reprofiling machine of the rails and finally when it is in position 3, to directly control a reprofiling machine without recording the programming and reprofiling parameters.

It is evident that the distributions of the reprofiling tools over the different zones are defined as a function of the values SA, SB, SC and of experience. Tables have been established after having made systematic tests to define, as a function of the values of SA, SB and SC, on the one hand the distribution of the tools on the different zones, and on the other hand the power assigned to each of said tools and/or the speed of displacement of the machine. It is these two tables which are memorized in 74 in the calculator.

Figure 14A:
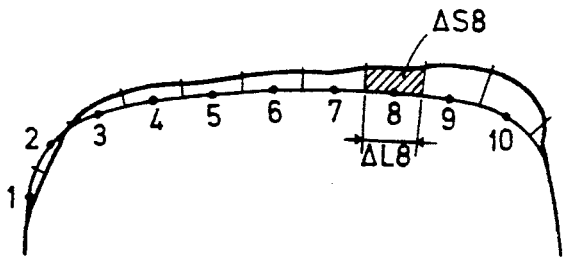
FIGS. 14*a*, 14*b* and 15 show for a variant of the method in which the transverse profile of the rail is divided in as many zones as reprofiling tools are available, the differences between the actual profile and the reference profile, respectively the metal sections Δ S to be removed.

In another variant, one can divide the reference profile in as many zones as there are reprofiling tools at disposition, for example ten. FIG. 14*a* shows the metal section related to the zone which is principally affected by each of the ten tools.

In that case one has to determine for each of the ten zones which will become the face of a circumscribed polygon, the quantity of metal to be removed, the number of passes to be made and the power to be applied.

Of course, during the optimalization of the reprofiling, the zones where the metal to be removed is naught necessitating no reprofiling tools, these tools will be assigned to the zones presenting the greatest metal section, the basic idea being always to effect the reprofiling in a minimum of passes.

Figure 14B:
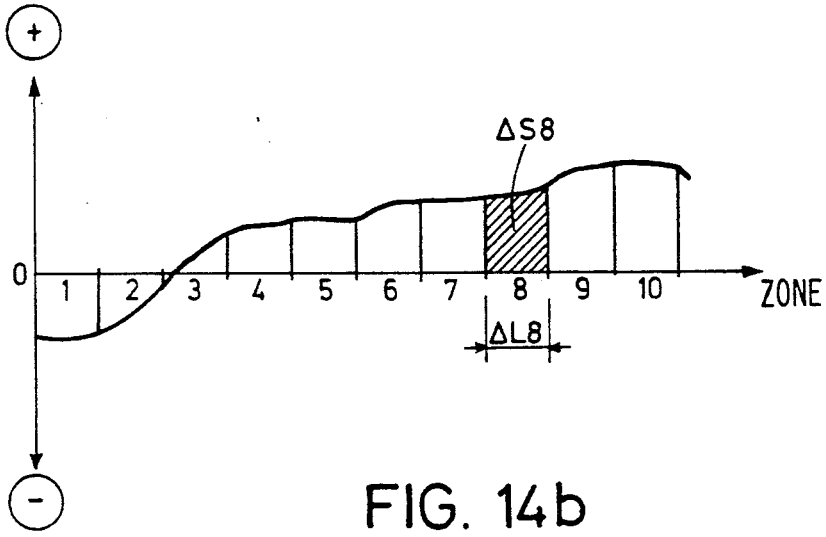

To simplify the comprehension, it is advantageous to modify the usual representation of the profiles as shown at FIG. 14*b*. The reference profile is developped in abscissa, the elements $\Delta L_1$, $\Delta L_2 \ldots \Delta L_{10}$ being listed the one at the end of the others giving the axis of the abscissal. The differences in profile are shown in ordinates, positively upwards (when there is an excess of metal); negatively (loss of metal) downwards. The scale of the ordinates can be amplified in order to increase the visualization of the problem.

Figure 15:
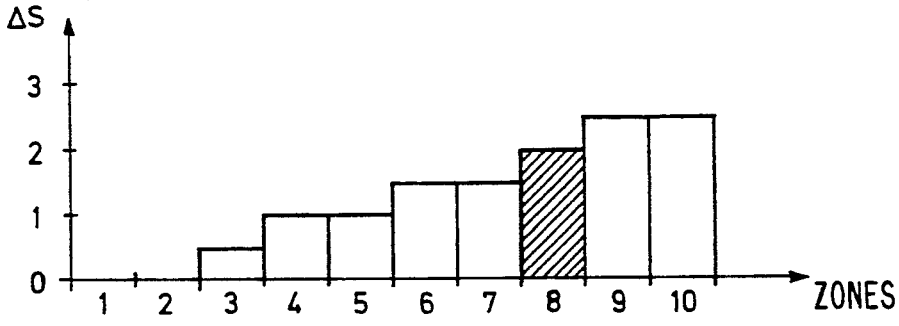

As one can see on the example given hereunder at FIG. 15:

| Metal to be removed | Number of tools | Metal to be removed for a tool: M |
|---|---|---|
| S1 = 0 | 0 | — |
| S2 = 0 | 0 | — |
| S3 = 0.5 | 1 | 0.5 |
| S4 = 1 | 1 | 1 |
| S5 = 1 | 1 | 1 |
| S6 = 1.5 | 1 | 1.5 |
| S7 = 1.5 | 1 | 1.5 |
| S8 = 1.8 | 1 | 1.8 |
| S9 = 2.5 | 2 | 1.25 |
| S10 = 2.5 | 2 | 1.25 |

The most sollicitated tool will be the one of the face number 8 with M=1:8.

For the values of:

Vmin=4 km/h; Vmax=6 km/h $C_{avg}$=6 dm³/h at 11 KW

One determines $$Smax = \frac{C}{Vmin} = \frac{6}{4} = 1.5$$

For the face (8) with $\Delta$ S=1:8 it is not sufficient, it is necessary to increase the power since it is not possible to diminish the speed, which will be V=4 Km/h=Vmin, so as to obtain $\Delta$ S equal to 1,8.

Consequently, $$S = \frac{C}{V} = 1.8 = \frac{C}{4}$$

where C=7:2 dm³/h and therefore using the curve (C, f(Pu)) of FIG. 4, Pu=12:5 kW.

The speed V=4 km/h being of course common for all tools, one deduces for each one the power to be applied from the diagram of FIG. 4.

As C=V,S, one calculates C and further Pu=f(C) and one obtains for the example given hereabove:

| Face | Number of tools | S/tool | C | Pu = f(C) kW |
|---|---|---|---|---|
| 1 | — | — | — | — |
| 2 | — | — | — | — |
| 3 | 1 | 0.5 | 2 | 7 |
| 4 | 1 | 1 | 4 | 9 |
| 5 | 1 | 1 | 4 | 9 |
| 6 | 1 | 1.5 | 6 | 12 |
| 7 | 1 | 1.5 | 6 | 12 |
| 8 | 1 | 1.8 | 7.2 | 12.5 |
| 9 | 2 | 1.25 | 5 | 10 |
| 10 | 2 | 1.25 | 5 | 10 |

So, one can conclude that on the studied section:

the total surface of metal to be removed is Stot=12:3 the reprofiling speed will be V=4 Km/h the distribution of the tools will be:

| Face | Number of the tools | Power in kW |
|---|---|---|
| 1 | — | — |
| 2 | — | — |
| 3 | 1 | 7 |
| 4 | 2 | 9 |
| 5 | 3 | 9 |
| 6 | 4 | 12 |
| 7 | 5 | 12 |
| 8 | 6 | 12.5 |
| 9 | 7 and 8 | 10 |
| 10 | 9 and 10 | 10 |

Of course, these values can be stored section by section as it is usual; they can also be avantageously used to control directly the reprofiling machine.

One can further note the following particularly avantageous points according to the method which has just been described:

a) The optimalization method described can without difficulty program on a computer.

b) The number of faces (ten in the last example) can be anyone, preferably equal to the number of tools, but this is not a necessary condition.

c) It is possible to optimalize the programming and reprofiling process for any machine, whatever its number of tools is and whatever its characteristics are.

d) As already stated above, all the results may be recorded for the programming of the work, but this method is also very convenient for the direct control of the reprofiling machines.

Finally, it is to be noted that when at the end of the reference section "L0" another tool configuration is necessary for the reprofiling, in position as well as in power, this can be made in two different ways.

a. All the tools are simultaneously displaced from their old position to the new one.

b. The tools located in the direction of movement of the machine are displaced the one after the other as a function of their spacing along the rail and of the speed of work, so that they will all take their new position at a same point of the track. This avoids, for reprofiling machines having a great length, to leave zones where the reprofiling is undetermined due to the spacing of the tools.

The description and the examples given hereabove use rotatives tools such as grinding tools, but it is evident that any reprofiling tools can be used particularly milling cutters, oscillating scrapers, abrasive, belt and so on.

What we claim is:

1. A method of programming the reprofiling of the rails of a railroad track, in which the track is divided in successive sections as from a starting point and in which for each of these sections one proceeds to the following operations for each line of rails:

a. measuring the amplitudes of longitudinal undulations of the rolling table of the rail;

b. measuring the transverse profile of the head of the rail;

c. comparing a reference profile to the measured transverse profile and determining the transverse metal section to be removed to correct the transverse profile of the rail;

d. determining as a function of the amplitudes of the longitudinal undulations of the rail the longitudinal metal section to be removed to correct the longitudinal profile of the rail;

e. determining as a function of operations c and d the total metal section to be removed;

f. determining as a function of the work speed, of the metal removal characteristics of each tool, and of the total section of metal to be removed, the minimal necessary number of tool-passes; and g. entering data collected from the preceding steps into a selected reprofiling machine so as to have a thus-programmed machine.

2. A method according to claim 1, in which the type of machine to be used for the reprofiling of the track is defined, the maximal and minimal speeds of work is fixed, the metal removal characteristics of the tools is defined, and the number of tools for each line of rails is determined; and in which the work speed of the machine or the metal removal capacity of the tools or both are modified to define a number of machine-passes which is a whole number.

3. A method according to claim 1, in which the work speed and the necessary number of passes are stored or recorded.

4. A method according to claim 1, further comprising the steps of dividing the head of the rail to be reprofiled in several parallel strips; individually determining for each of said strips the total metal section to be removed; individually determining for each of the strips the necessary number of tool-passes; assigning a determined number of tools to each said strip as a function of the metal section to be removed and optimalizing the power of each tool as a function of the work speed, of the number of tools for each strips, and of the metal removal characteristics of the tool.

5. A method according to claim 1, further comprising the steps of selecting as a function of the total section of metal to be removed and of its repartition onto the rail, a standard position tool configuration.

6. A method according to claim 1, further comprising directly controlling by means of at least certain parameters, a reprofiling machine of the rails of a railroad track.

7. A method according to claim 1, in which when a different tool configuration is necessary for a section of track than for the preceding section, one displaces the tools either simultaneously, or subsequently as a function of their spacing along the rail.

8. A device for the reprofiling of the rails of a railroad track, comprising for each line of rails:

a. means for measuring the amplitudes of the longitudinal undulations of the rolling table of the rail;

b. means for measuring the transverse profile of the head of the rail;

c. comparison means of a reference profile with the measured transverse profile and means to determine the transverse metal section to be removed to correct the transverse profile of the rail;

d. means for determining as a function of the amplitude of the longitudinal undulations of the rail the longitudinal metal section to be removed to correct the longitudinal profile of the rail;

e. means for determining as a function of the operations c and d above the total section of metal to be removed; and f. means for determining as a function of the work speed, of the metal removal characteristics of each tool, and of the total section of metal to be removed, the minimal necessary number of tool-passes.

9. A device according to claim 8, which comprises means for storing the type of machine having to be used for the reprofiling of the track, the maximal and minimal work speeds, the metal removal characteristics of the tools; and calculating means defining the number of tools for each line of rails, the speed of work of the machine and/or the metal removal capacity of the tools to define a number of machine-passes which is a whole number.

10. A device according to claim 9, comprising selecting means, as a function of the total section of metal to be removed and of its repartition on the rail, of a standard tool configuration in position among the ones memorized in the storing means.

11. A device according to claim 10, further comprising means for directly controlling reprofiling means of the rails of a railroad track by means of certain of the stored or calculated parameters.

12. A device according to claim 8, which comprises means defining the position of the machine with respect to the track.

13. A device according to claim 9, which comprises positioning means of the tools and setting means of their power onto sidelines of the rail as a function of the total section of metal to be removed and of its repartition on said sidelines.

14. A device according to claim 8, which comprises means to modify the inclination of the tools around the rail, either simultaneously, or the one after the other as a function of their spacing along the rail.

15. A method of reprofiling the rails of a railroad track, in which the track is divided in successive sections as from a starting point and in which for each of these sections one proceeds to the following operations for each line of rails:

a. measuring the amplitudes of longitudinal undulations of the rolling table of the rail;
b. measuring the transverse profile of the head of the rail;
c. comparing a reference profile to the measured transverse profile and determining the transverse metal section to be removed to correct the transverse profile of the rail;
d. determining as a function of the amplitudes of the longitudinal undulations of the rail the longitudinal metal section to be removed to correct the longitudinal profile of the rail;
e. determining as a function of operations c and d the total metal section to be removed;
f. determining as a function of the work speed, of the metal removal characteristics of each tool, and of the total section of metal to be removed, the minimal necessary number of tool-passes;
g. entering data collected from the preceding steps into a selected reprofiling machine so as to have a thus-programmed machine; and
h. reprofiling the rails of a railroad track using the thus-programmed machine.

* * * * *